US007000414B2

(12) United States Patent
Lee et al.

(10) Patent No.: US 7,000,414 B2
(45) Date of Patent: Feb. 21, 2006

(54) DEFROST AND REFRIGERATOR EMPLOYING THE SAME

(75) Inventors: Byoung-in Lee, Milyang (KR); Sung-kwan Park, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 339 days.

(21) Appl. No.: 10/632,864

(22) Filed: Aug. 4, 2003

(65) Prior Publication Data

US 2005/0081548 A1 Apr. 21, 2005

(30) Foreign Application Priority Data

Aug. 6, 2002 (JP) ..... 2002-46390
Jan. 7, 2003 (JP) ..... 10-2003-0000847

(51) Int. Cl.
*F25D 21/06* (2006.01)

(52) U.S. Cl. ..... 62/227; 62/151
(58) Field of Classification Search ..... 62/151, 62/227, 431, 432, 441; 165/104.11, 104.21

See application file for complete search history.

(56) References Cited

U.S. PATENT DOCUMENTS 5,941,085 A 8/1999 Jeon
6,427,463 B1 * 8/2002 James ..... 62/186

FOREIGN PATENT DOCUMENTS

| | | |
|---|---|---|
| JP | 4-302981 | 10/1992 |
| JP | 8-193771 | 7/1996 |
| JP | 1997-0004344 | 3/1997 |
| JP | 11-23135 | 1/1999 |
| JP | 20-01 47043 | 3/1999 |
| JP | 11-173711 | 7/1999 |
| JP | 2000-304415 | 11/2000 |
| JP | 2001-12843 | 1/2001 |
| KR | 10-0189625 | 1/1999 |
| KR | 1999-005704 | 1/1999 |
| KR | 10-0208886 | 4/1999 |
| KR | 10-0216955 | 6/1999 |

OTHER PUBLICATIONS 2001-12843 Generally relates to "Defroster and Refrigerator Employing the Same."

(Continued)

*Primary Examiner*—Melvin Jones
(74) *Attorney, Agent, or Firm*—Staas & Halsey LLP

(57) ABSTRACT

A refrigerator having a main body, and a compressor and an evaporator in the main body, comprises a heat pipe forming a closed loop so as to allow the refrigerant to be circulated therein; a first heat exchanger provided in the heat pipe, absorbing heat generated from the compressor; a second heat exchanger provided in an upper part between the heat pipe and the first heat exchanger adjacent to the evaporator, discharging heat into the evaporator; and a control valve positioned between the first and second heat exchangers, opening and closing the heat pipe, wherein the refrigerant cooled and liquified in the second heat exchanger forces out the refrigerant heated and gasified in the first heat exchanger by gravity, when the control valve is opened.

32 Claims, 8 Drawing Sheets

OTHER PUBLICATIONS 1999-005704 Generally relates to "Defroster and Refrigerator Employing the Same."
10-0189625 Generally relates to "Defroster and Refrigerator Employing the Same."
10-0208886 Generally relates to "Defroster and Refrigerator Employing the Same."
10-0216955 Generally relates to "Defroster and Refrigerator Employing the Same."

* cited by examiner

DEFROST AND REFRIGERATOR EMPLOYING THE SAME

CROSS-REFERENCE TO RELATED APPLICATIONS

This application claims the benefit of Korean Application No. 2002-46390, filed Aug. 6, 2002 and Korean Application No. 2003-00847 filed Jan. 7, 2003, in the Korean Intellectual Property Office, the disclosure of which is incorporated herein by reference.

BACKGROUND OF THE INVENTION

1. Field of the Invention

The present invention relates to refrigerators, and more particularly, to a defroster to remove the frost deposited on an evaporator, and a refrigerator employing the defroster.

2. Description of the Related Art

Generally, a refrigerating device comprises a compressor compressing a gaseous refrigerant at a high temperature and with a high pressure, a condenser to condense the compressed gaseous refrigerant into a liquified refrigerant, a capillary tube to convert the liquified refrigerant to be conditioned at low temperature and low pressure, and an evaporator to refrigerate the ambient air by absorbing latent heat around the evaporator to gasify the liquified refrigerant at low temperature and with low pressure from the capillary tube. The insides of a freezer chamber and a refrigerator chamber can be cooled by supplying the air cooled around the evaporator into the insides of both compartments.

This kind of refrigerating device can be used in a various manner, for example, in heat exchanging devices such as a refrigerator and an air conditioner, etc. Hereinafter, a refrigerating device employed in a refrigerator will be described by way of example.

A general refrigerator includes a main body partitioned into a freezer compartment and a refrigerator compartment, doors rotationally opening and closing front openings of the freezer compartment and the refrigerator compartment, and a refrigerating device cooling insides of both compartments.

Since the surface temperature of the evaporator provided in the refrigerating device of the refrigerator is lower than the temperature of the air within the refrigerator, moisture mixed with the air inside the refrigerator is deposited on the surface of the evaporator in the form of frost. This frost will cause the evaporator's ability for heat exchange to be deteriorated. Thus, defrosting devices, such as an electric heater, are required to remove the frost deposited on the evaporator.

As illustrated in FIGS. 1 and 2, a defroster employed in a conventional refrigerator comprises a defrosting heater 50 provided in a lower part of a cooler chamber 30 positioned in back of the freezer compartment 70 of the refrigerator and removing the frost deposited on a cooler 40 by generating heat when it is placed in a defrosting mode in response to an electric signal from a controller; a heat exchange part 4 formed by bending a defrosting tube 1 vertically several times and situated in back of the cooler 40 provided inside the cooler chamber 30; and a reflection plate 31 of an aluminum material, mounted in back of the heat exchange part 4 so as to prevent the heat radiated from the heat exchange part 4 from being transferred backward toward the cooler chamber 30.

The defrosting tube 1 is extended downward from the heat exchange part 4 and connected to a first side of a storing tank 2, being communicated with the inside of the storing tank 2, and is extended upward from a second side of the storing tank 2 and connected to the heat exchange part 4 via a pump 3. Here, the storing tank 2 is mounted on the top of the compressor 21 in a component chamber 20 and stores an antifreezing solution to defrost.

Further, in back of the freezer compartment 70, there are provided a rubber insulation 26, a cool air discharging outlet 37 formed above the rubber insulation 26, and a thermo-damper 35 provided adjacent to the cool air discharging outlet 37 and opening and closing the cool air discharging outlet 37 in response to the electric signal from the controller.

In the conventional refrigerator employing the above-described configuration, when the controller changes the mode of the refrigerator from a cooling mode into a defrosting mode in response to a signal from a frost sensor (not shown) or from a defrosting timer (not shown), an operation of the compressor 21 is suspended and a cooling system thereof is suspended accordingly. Then, the defrosting heater 50 starts to generate heat in response to an operation of the defrosting system, and the pump 3 and the thermo-damper 35 are operated.

Then, the antifreezing solution, such as ethylene glycol, propylene glycol, etc., stored inside the storing tank 2 is supplied by the pump 3 into the heat exchange part 4 within the cooler chamber 30 through the defrosting tube 1, and at the same time, a cool air discharging outlet 37 is closed by the thermo-damper 35 and a freezer fan 33 is rapidly rotated.

The antifreezing solution stored inside the storing tank 2 is heated up by the heat generated by an operation of the compressor 21 and conditioned at a high temperature of 90° C.~100° C. in the cooling mode, and is discharged along the defrosting tube 1 if the mode of the refrigerator is changed into the defrosting mode according to a signal from the controller, to thereby cause the heat exchange part 4 to generate heat, and then discharged into the cooler 40 by a forced hot air generated by rotation of a freezer fan 33, to thereby cause the frost deposited on the cooler 40 to be removed.

As described above, defrosting has been performed with the heat generated by the defrosting heater 50 mounted on the bottom of the cooler in the conventional refrigerator. In addition, the defrosting is effectively performed within a short period of time by supplying the antifreezing solution, heated with the use of the heat from the compressor 21, into the heat exchange part 4 of the cooler chamber 30 and discharging the heat radiated from the heat exchange part 4 into the cooler 40 by the forced hot air generated by means of the freezer fan 33 in the state that the thermo-damper 35 closes the cool air discharging outlet 37 so as to prevent the forced hot air from being flowed toward the freezer compartment 70.

However, the defroster used in the conventional refrigerator is disadvantageous in that it separately needs a defrosting heater to remove the frost on the cooler, and also uses a pump to supply the heat from the compressor into the heat exchange tube assembly, thereby having a complicated structure and consuming extra power.

Further, conventional refrigerators have been designed to perform the defrosting operation in the range of 10 hours to 48 hours, which may vary depending on some conditions of the refrigerators, and thus, this causes the evaporator to be deteriorated in performance because of the frost deposited for a long time before a next defrosting operation commences after the previous defrosting completed.

Further, if the frost is partially deposited on the evaporator, a part of the evaporator, on which the frost is not deposited, is heated while the defrosting operation is performed, thereby increasing the inner temperature of the refrigerator.

SUMMARY OF THE INVENTION

Accordingly, it is an aspect of the present invention to provide a defroster and refrigerator employing the same, having a simplified structure, reducing the power consumption, and further improving a performance of the evaporator.

Additional aspects and advantages of the invention will be set forth in part in the description which follows and, in part, will be obvious from the description, or may be learned by practice of the invention.

The foregoing and other aspects of the present invention are achieved by providing a refrigerator having a main body, and a compressor and an evaporator in the main body, comprising a heat pipe forming a closed loop so as to allow the refrigerant to be circulated therein; a first heat exchanger provided in the heat pipe, absorbing heat generated from the compressor; a second heat exchanger provided in an upper part between the heat pipe and the first heat exchanger adjacent to the evaporator, discharging heat into the evaporator; and a control valve positioned between the first and second heat exchangers, opening and closing the heat pipe, wherein the refrigerant cooled and liquified in the second heat exchanger forces out the refrigerant heated and gasified in the first heat exchanger by gravity, when the control valve is opened.

According to an aspect of the invention, the refrigerator further comprises a refrigerant container positioned between the control valve and the second heat exchanger, storing therein the refrigerant cooled and liquified in the second heat exchanger.

According to an aspect of the invention, the first heat exchanger includes a heat storing tank in contact with the compressor, storing therein the heat generated from the compressor.

According to an aspect of the invention, the refrigerator further comprises a temperature sensing part sensing a surface temperature of the evaporator.

According to an aspect of the invention, the control valve is opened when the compressor is suspended, and is closed when the compressor resumes operation or the temperature sensed by the temperature sensing part is higher than a predetermined reference temperature.

According to an aspect of the invention, the control valve alternates between the opened state and the closed state at regular intervals when the compressor is in suspension and the temperature sensed by the temperature sensing part is lower than the reference temperature.

According to an aspect of the invention, the second heat exchanger is bent several times in correspondence to the evaporator.

According to an aspect of the invention, the first heat exchanger is formed by winding the heat pipe in contact with the compressor spirally several times, to store therein the heat generated from the compressor.

According to another aspect of the present invention, the above and other aspects may be also achieved by providing a defroster defrosting an evaporator provided in a refrigerating device, comprising a heat pipe forming a closed loop so as to allow the refrigerant to be circulated therein; a first heat exchanger provided in the heat pipe, absorbing heat generated from a compressor provided in the refrigerating device; a second heat exchanger provided in an upper part between the heat pipe and the first heat exchanger adjacent to the evaporator, discharging heat into the evaporator; and a control valve positioned between the first and second heat exchangers, opening and closing the heat pipe, wherein the refrigerant cooled and liquified in the second heat exchanger is circulated while forcing out the refrigerant heated and gasified in the first heat exchanger by gravity, when the control valve is opened.

BRIEF DESCRIPTION OF THE DRAWINGS

These and other aspects and advantages of the present invention will become apparent and more readily appreciated from the following description of the embodiments, taken in conjunction with the accompany drawings of which.

DETAILED DESCRIPTION OF THE PREFERRED EMBODIMENT

Figure 1:
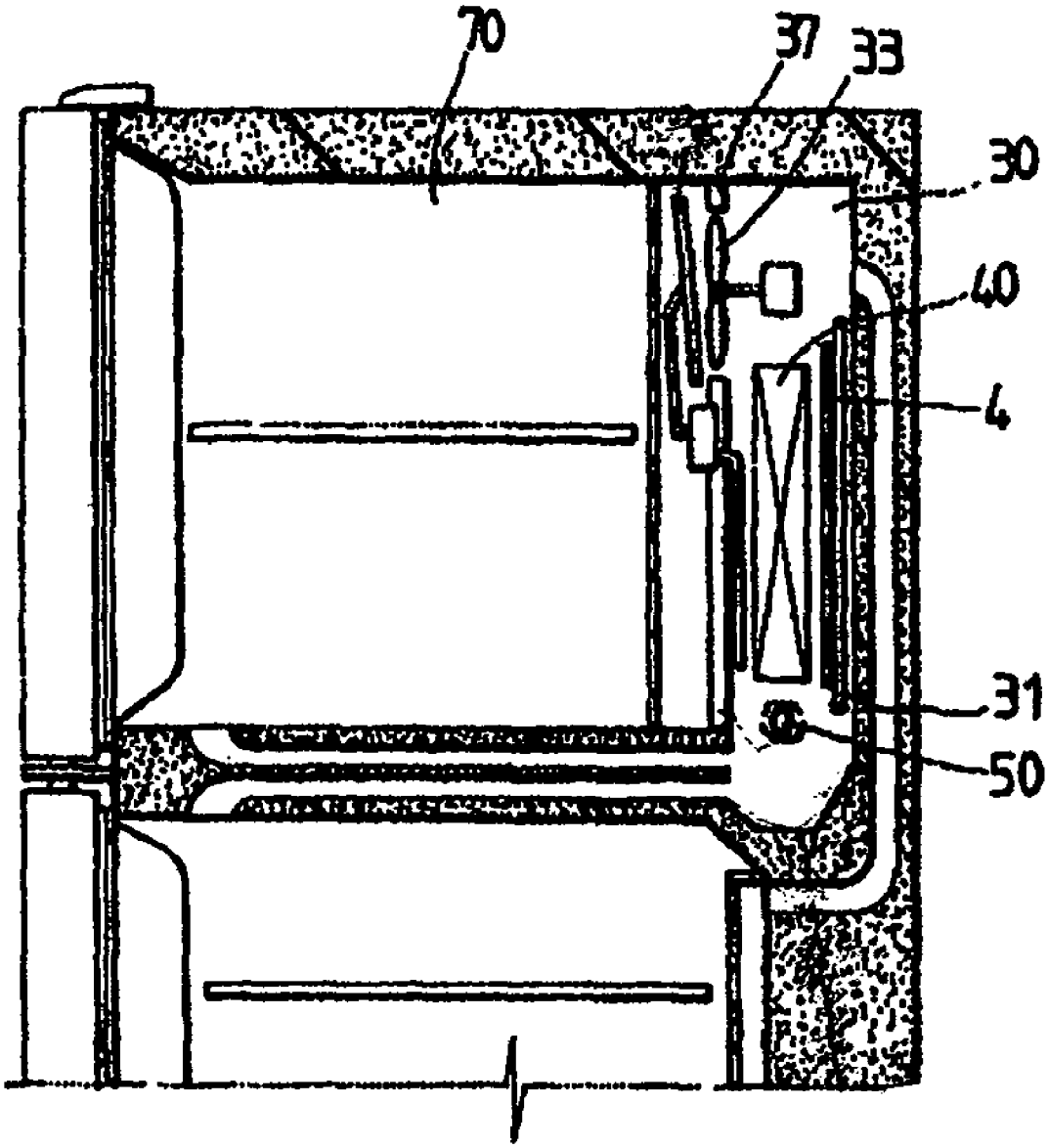
FIG. 1 (PRIOR ART)
FIG. 1 is a side view of a defroster of a conventional refrigerator.
Figure 2:
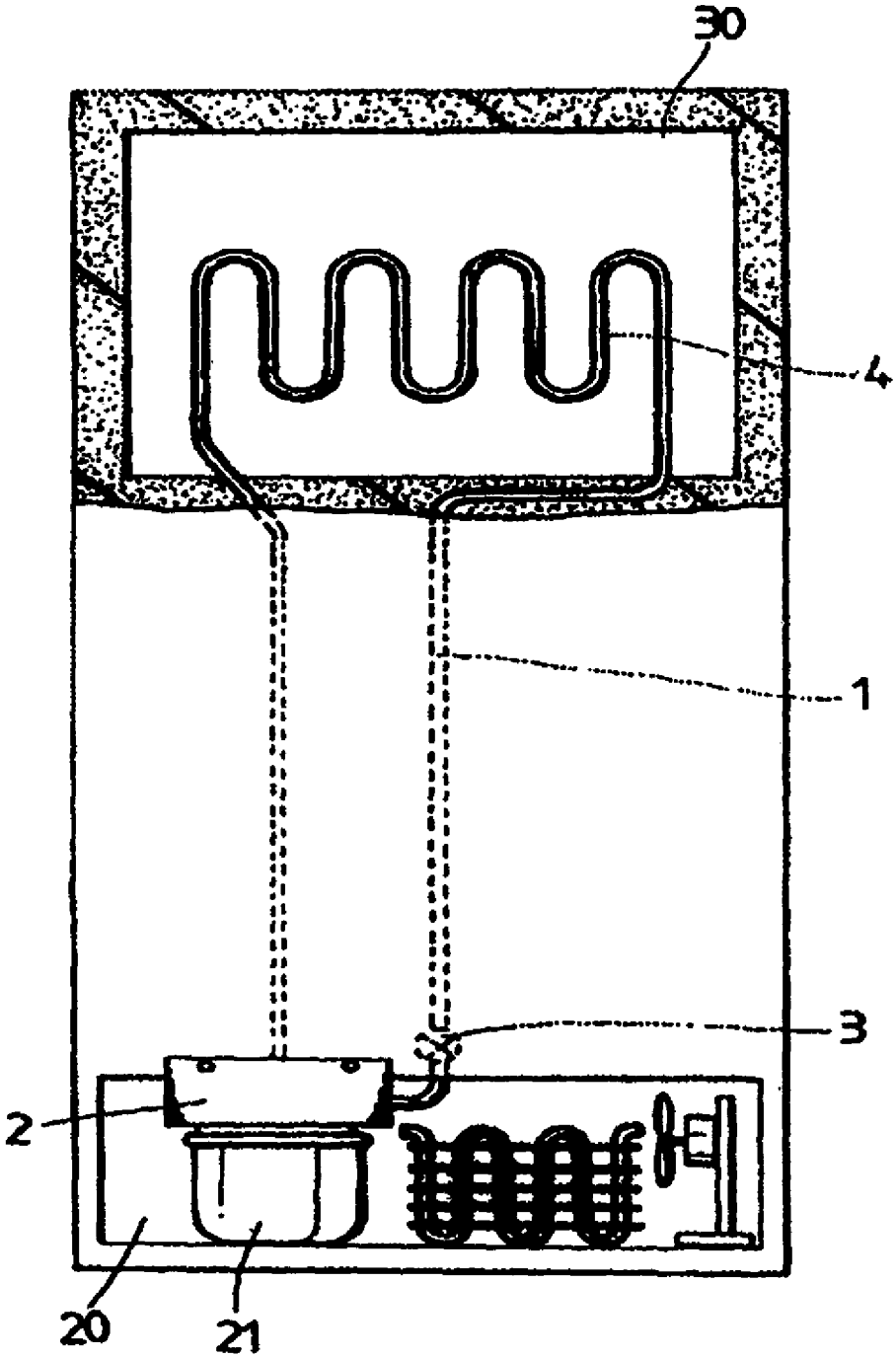
FIG. 2 (PRIOR ART)
FIG. 2 is a rear sectional view of the conventional refrigerator.

Reference will now be made in detail to the embodiments of the present invention, examples of which are illustrated in the accompanying drawings, wherein like reference numerals refer to like elements throughout. The embodiments are described below in order to explain the present invention by referring to the figures.

Hereinafter, the present invention will be described below with reference to the accompanying drawings.

Figure 3:
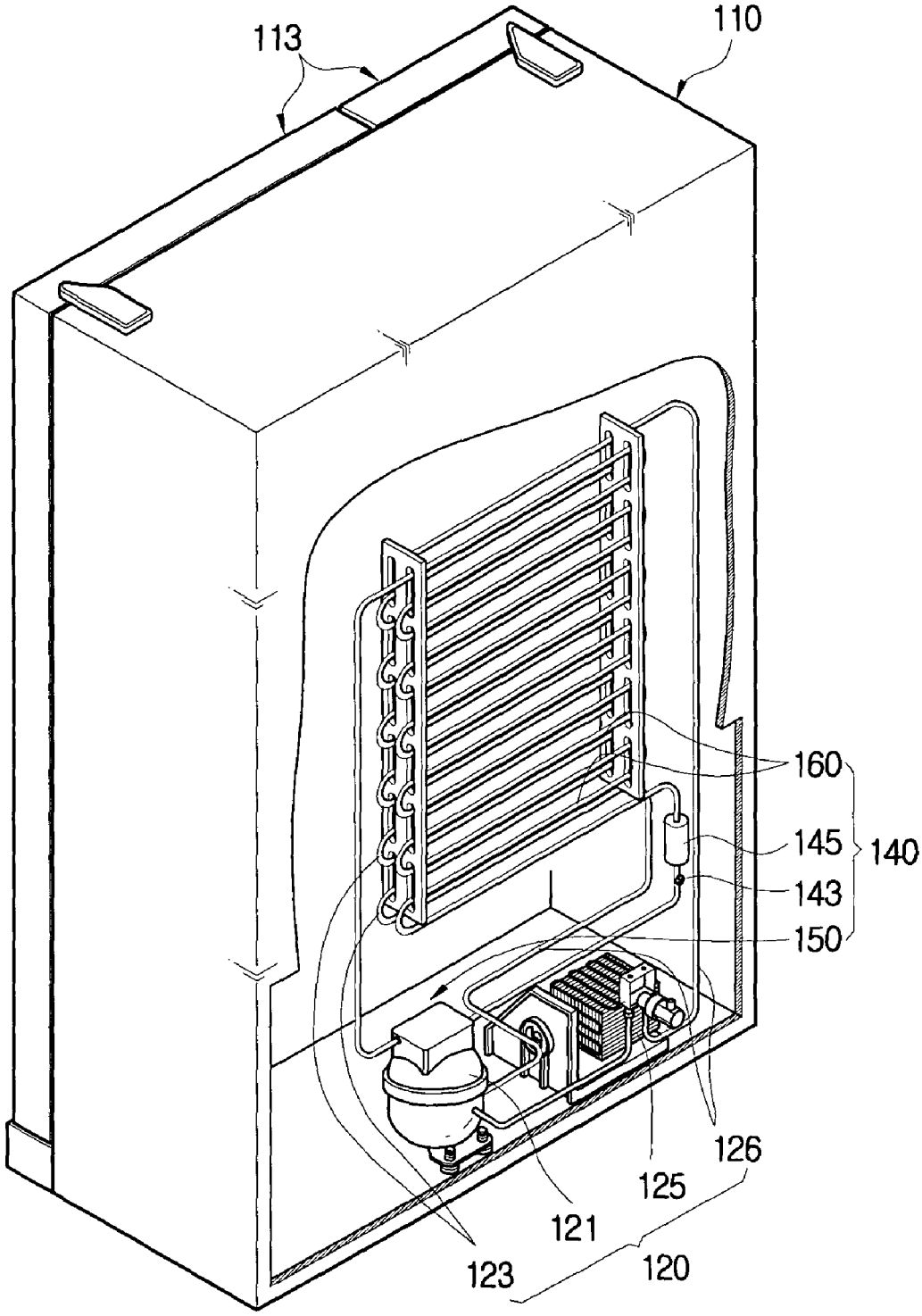
FIG. 3 is a rear perspective view of a refrigerator according to a first embodiment of the present invention.
Figure 4:
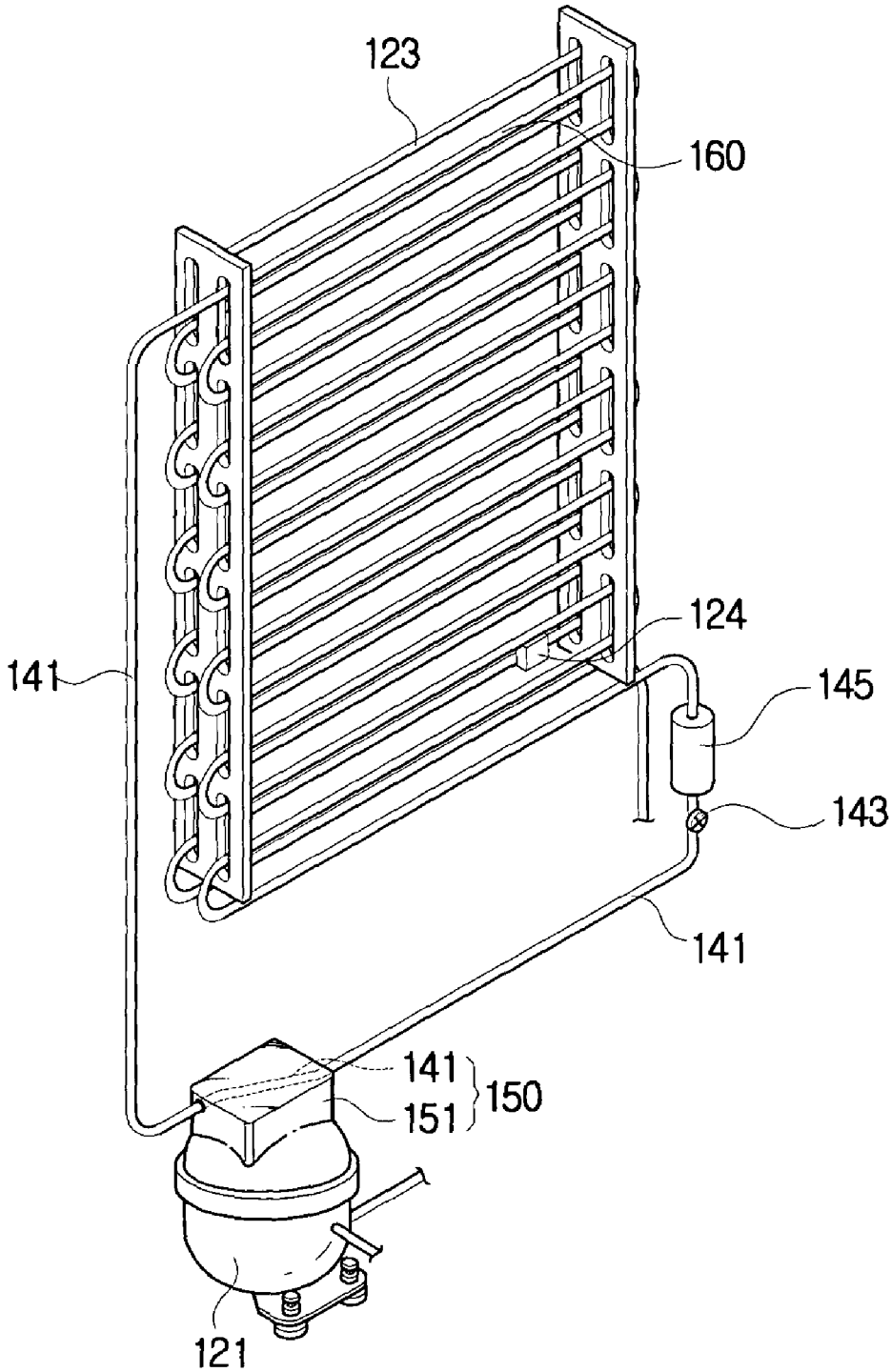
FIG. 4 is a partial perspective view of the refrigerator shown in FIG. 3.

As illustrated in FIGS. 3 and 4, a refrigerator according to a first embodiment of the present invention comprises a main body 110 partitioned into a freezer compartment and a refrigerator compartment (not shown), doors 113 opening and closing front openings of the main body 110, a refrigerating device 120 provided in a lower part of the main body 110, equipped with a compressor 121 and an evaporator 123, etc. to cool the insides of the freezer compartments and the refrigerator compartments, and a defroster 140 to remove frost deposited on the surface of the evaporator 123.

Frost is generated on the surface of the evaporator 123 provided in the refrigerating device 120 by the temperature difference between the ambient air and the surface of the evaporator 123. This frost causes the evaporator's ability for heat exchange to be deteriorated while the refrigerator is in operation.

The refrigerating device 120 according to the present invention is comprised of a compressor 121 compressing a gaseous refrigerant at high temperature and with high pressure, a condenser 126 condensing the compressed gaseous refrigerant into a liquified refrigerant, an evaporator 123 cooing ambient air by absorbing latent heat around the evaporator, to gasify the liquified refrigerant, and a refrigerant tube 125 connecting the compressor 121, the condenser 126 and the evaporator 123 so as to allow the refrigerant to be circulated.

The insides of the freezer compartment and the refrigerator compartment can be cooled by the air cooled around the evaporator 123 supplied to the insides of both compartments.

In order to remove the frost generated on the surface of the evaporator 123 provided in the refrigerating device 120 by the temperature difference between the ambient air and the surface of the evaporator 123, a defroster is provided.

The defroster 140 comprises a heat pipe 141 forming a closed loop, through the inside of which a refrigerant can be circulated, a first heat exchanger 150 provided at the lower part of the heat pipe 141, absorbing heat generated from the compressor 121, a second heat exchanger 160 provided in the upper part of the heat pipe 141 closer to the evaporator 123, discharging the heat into the evaporator 123, a control valve 143 provided between the first heat exchanger 150 and the second heat exchanger 160, a refrigerant container 145 provided between the control valve 143 and the second heat exchanger 160, storing therein the refrigerant cooled and liquified in the second heat exchanger 160, and a temperature sensing part 124 sensing a surface temperature of the evaporator 123.

The first heat exchanger 150 contacts the top of the compressor 121 and includes a heat storing tank 151 storing waste heat therein generated from the compressor 121, whose surface temperature is 50° C. or more, while the refrigerator is in operation.

The heat storing tank 151 is preferably made of a metallic material having an excellent heat conductivity. The inside of the heat storing tank 151 is constructed enough to allow the heat pipe 141 to pass therethrough, storing the waste heat collected from the compressor 121 and transferring it to the heat pipe 141. Thus, the refrigerant being circulated inside the heat pipe 141 is gasified as its temperature increases by the waste heat from the compressor 121. It is preferable that the refrigerant comprises ethanol, having a lower specific heat, but it may comprise other materials as far as their temperatures can readily increase and they can be easily gasified by the waste heat from the compressor 121.

The second heat exchanger 160 is bent several times, in correspondence to the evaporator 123, in order to smoothly perform heat exchange with the evaporator 123. The refrigerant gasified at a high temperature flows into the upper part of the second heat exchanger 160 through the first heat exchanger 150 and is then condensed while it passes the second heat exchanger 160, and the condensed refrigerant is discharged downward by gravity. In this course, the defrosting operation is performed by the heat discharged as the refrigerant at a high temperature passing through the inside of the second heat exchanger 160 is condensed. The refrigerant flowing off the second heat exchanger 160 discharges the heat it has, thereby being liquified.

The temperature sensing part 124 is provided in a lower part of the evaporator 123 to sense the surface temperature of the evaporator 123, and the control valve 143 is closed when the temperature sensed by the temperature sensing part 124 is higher than a predetermined reference temperature. Preferably, the reference temperature suitable for the present invention is 1° C., so as to allow the whole frost deposited on the surface of the evaporator 123 to be removed; however, the reference temperature can be set up in the neighborhood of 1° C. in consideration of the setup temperature of the freezer compartment and the refrigerator compartment, an outer air temperature, etc.

The control valve 143 is mounted on the heat pipe 141 between the refrigerant container 145 and the first heat exchanger 150, to control supply of the refrigerant flowing off the second heat exchanger 160 back into the first heat exchanger 150. The control valve 143 is opened when the temperature sensed by the temperature sensing part 124 is lower than the reference temperature and the operation of the compressor 121 is suspended, and it is closed when the temperature sensed by the temperature sensing part 124 is higher than the reference temperature or the compressor 121 resumes its operation.

The refrigerant container 145 is provided on the heat pipe 141, connecting the control valve 143 and the second heat exchanger 160. It is preferable that the refrigerant container 145 is positioned over the first heat exchanger 150. The refrigerant container 145 takes the form of a cylinder so as to store therein the refrigerant cooled and liquified at the second heat exchanger 160, but may take different forms, for example, of a polygonal container and so on, to store therein the liquified refrigerant.

When the control valve 143 is opened, the refrigerant cooled and liquified in the second heat exchanger 160 forces out the refrigerant heated and gasified in the first heat exchanger 150 from the refrigerant container 145 positioned over the first heat exchanger 150 by gravity. The liquified refrigerant is heated and gasified while passing through the first heat exchanger 150, and flows into the second heat exchanger 160. This refrigerant, in a condensed state after removing the frost at a low temperature, is moved into the refrigerant container 145. Through these steps, the refrigerant is circulated. When the control valve 143 is closed, the refrigerant cannot be circulated. After the liquified refrigerant is wholly gasified, the defrosting process is completed. Therefore, the frost deposited on the evaporator 123 can be easily defrosted by circulating the refrigerant with the use of the waste heat from the compressor 121, without consuming extra power.

Figure 5:
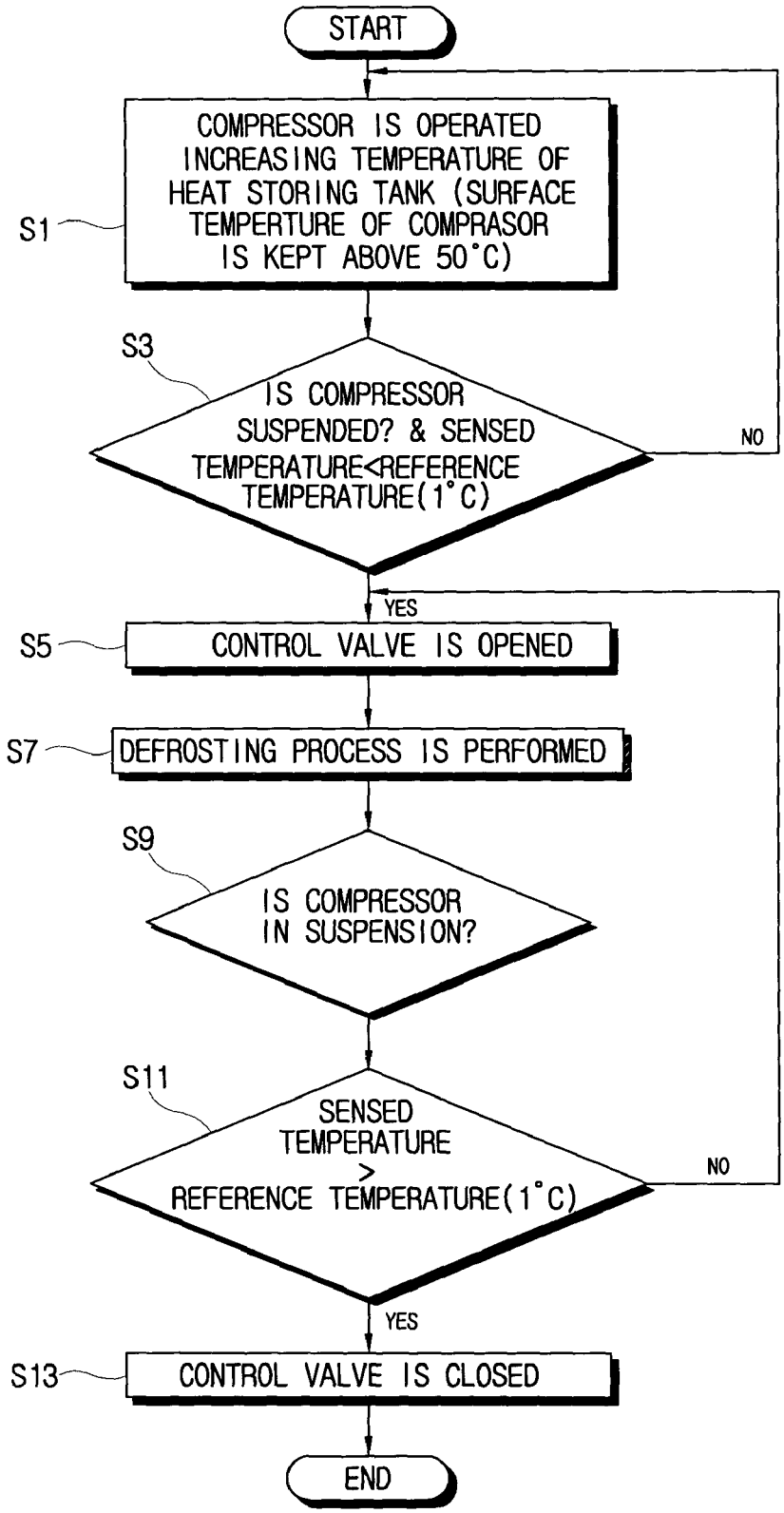
FIG. 5 is a flow chart showing a defrosting process of the refrigerator according to the first embodiment of the present invention.
Figure 6:
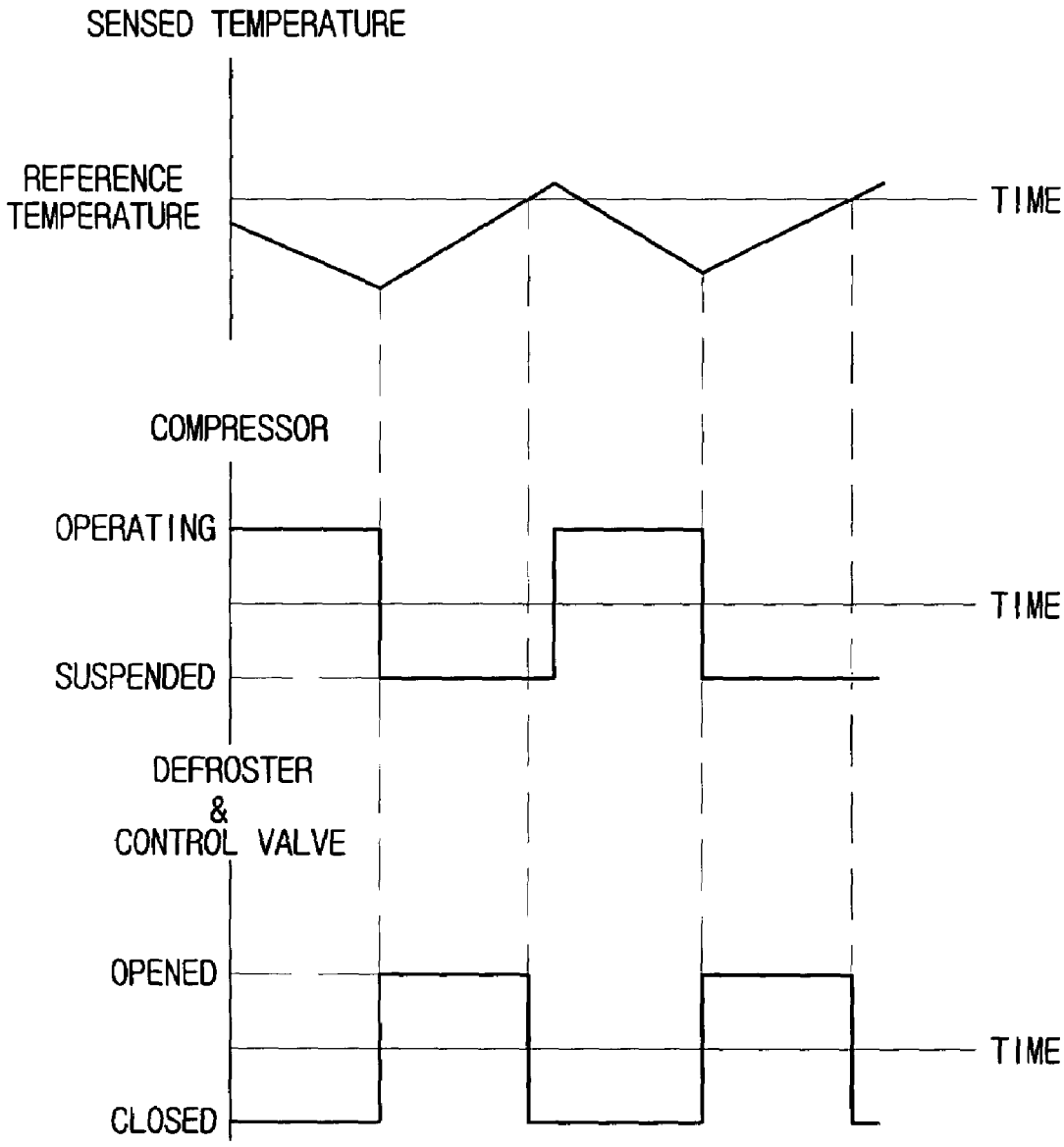
FIG. 6 is graphs showing a defrosting operation of the refrigerator according to the first embodiment of the present invention.

An operation of the defroster of the refrigerator according to the first embodiment will be described with reference to the flow chart and the graphs illustrated in FIGS. 5 and 6.

When the refrigerator starts its operation, the compressor 121 is operated to cool the freezer and refrigerator compartments of the refrigerator. According as the compressor 121 is operated, the surface temperature of the compressor 121 is kept above 50° C., and therefore the temperature of the heat storing tank 151 increases because the heat storing tank 151 absorbs the waste heat from the compressor 121 (S1). It is determined whether or not the compressor 121 is being operated and whether or not the surface temperature of the evaporator 123 sensed by the temperature sensing part 124 is higher than the reference temperature (S3). In the case where the compressor 121 is being operated or the temperature sensed by the temperature sensing part 124 is higher than the reference temperature, i.e., 1° C., the heat storing tank 151 continues absorbing the waste heat of the compressor 121. In the case where the compressor 121 is suspended and the temperature sensed by the temperature sensing part 124 is lower than 1° C., the control valve 143 is opened (S5). According as the control valve 143 is opened, the liquified refrigerant is transferred from the refrigerant container 145 to the first heat exchanger 150 by its own weight and heated and gasified in the first heat exchanger 150, and then the gasified refrigerant is transferred to the second heat exchanger 160 because new liquified refrigerant is transferred to the first heat exchanger 150, forcing out the gasified refrigerant, so that the defrosting process is performed (S7). Thereafter, it is determined whether or not the compressor 121 is being operated (S9). In the case where the compressor 121 is being operated, the control valve 143 is closed (S13), thereby completing the defrosting process and allowing the heat storing tank 151 to absorb the waste heat from the compressor 121. In the case where the compressor 121 is in suspension, the temperature sensed by the temperature sensing part 124 provided below the evaporator 123 is compared with the reference temperature, i.e., 1° C. (S11). When the temperature sensed by the temperature sensing part 124 is lower than 1° C., the control valve 143 is steadily in an opened state, continuing the defrosting process. When the temperature sensed by the temperature sensing part 124 is higher than 1° C., the control valve 143 is closed (S13), thereby complete the defrosting process. Since the defrosting process is performed whenever the temperature sensed by the temperature sensing part 124 is lower than 1° C. and the compressor 121 is in suspension, the frost deposited on the evaporator 123 is removed even though it is of a small amount, to thereby enhance the performance of the evaporator.

In the above-described embodiment, a refrigerant container 145 in a cylindrical form is separately provided between the control valve 143 and the second heat exchanger 160. However, the refrigerant container may be in various forms as far as it enables the liquified refrigerant to be smoothly circulated when the control valve 143 is opened, or otherwise, the refrigerant container 145 may be removed.

Figure 7:
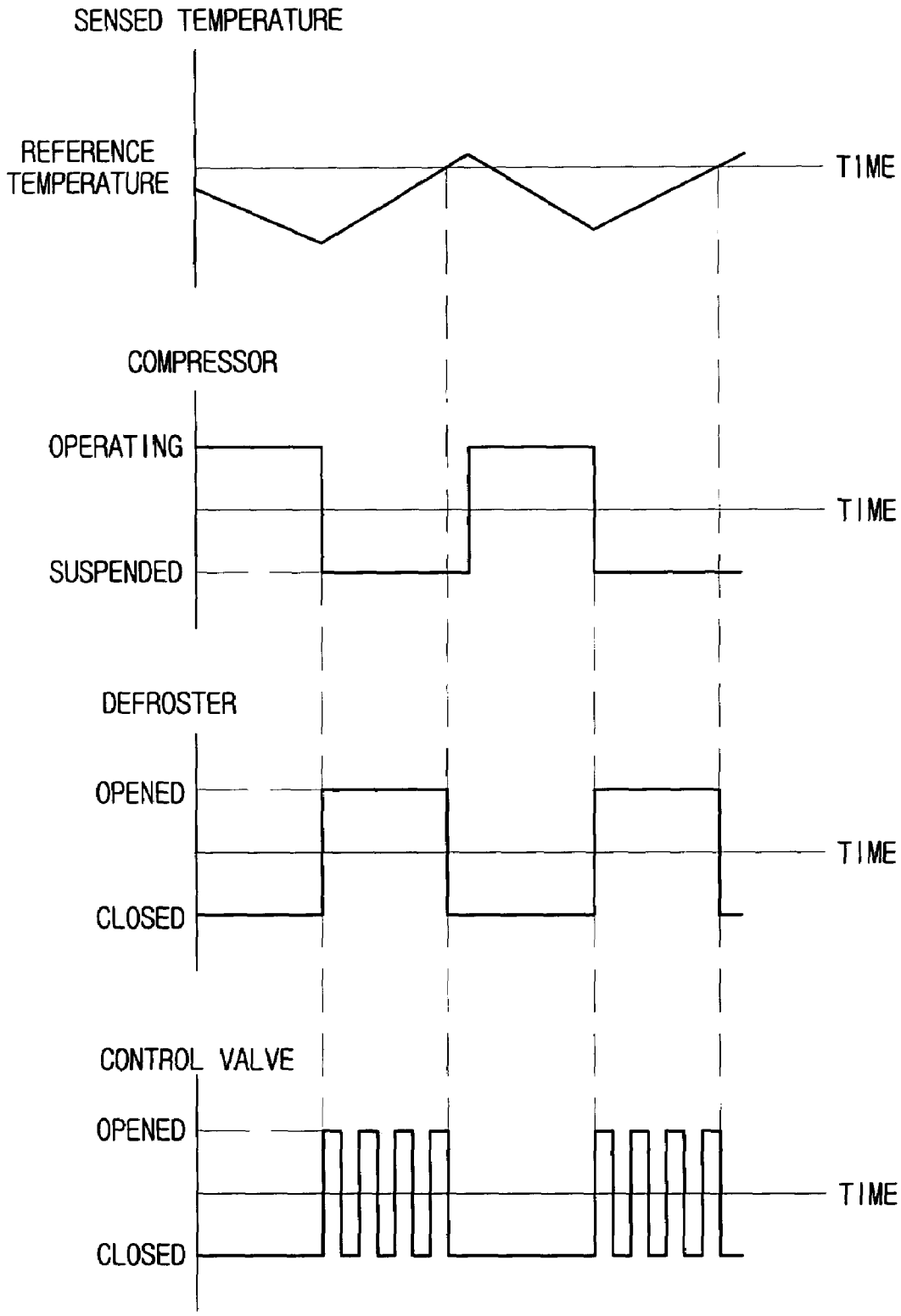
FIG. 7 is graphs showing a defrosting operation of the refrigerator according to a second embodiment of the present invention.

FIG. 7 is graphs showing a defrosting operation of the refrigerator according to a second embodiment of the present invention.

Like the first embodiment, the control valve 143 of the defroster 140 of the refrigerator according to the second embodiment is opened when the temperature sensed by the temperature sensing part 124 is lower than the reference temperature and the operation of the compressor 121 is suspended, and is closed when the temperature sensed by the temperature sensing part 124 is higher than the reference temperature or the compressor 121 resumes its operation.

However, according to the second embodiment, the control valve 143 alternates between the opened state and the closed state at regular intervals when the temperature sensed by the temperature sensing part 124 is lower than the reference temperature and the operation of the compressor 121 is suspended. Here, the opening period can be set up variously according to the amount of the liquified refrigerant transferred from the refrigerant container 145 to the first heat exchanger 150 through the heat pipe 141 when the control valve 143 is opened, etc. Further, the closing period can be set up variously according to the time taken to heat and gasify the liquified refrigerant in the first heat exchanger 150 when the control valve 143 is opened.

For example, on the assumption that the control valve 143 alternates between the opened state and the closed state at regular intervals of five seconds, when the temperature sensed by the temperature sensing part 124 is lower than the reference temperature and the operation of the compressor 121 is suspended, the control valve 143 is opened for the five seconds, so that the liquified refrigerant is transferred from the refrigerant container 145 to the first heat exchanger 150 by its own weight and simultaneously heated and gasified in the first heat exchanger 150 to perform the defrosting operation by transferring the gasified refrigerant to the second heat exchanger 160. Then, for the next five seconds, the liquified refrigerant remained in the first heat exchanger 150 is heated and gasified in the state that the control valve 143 is closed. Then, for the next five seconds, the control valve 143 is opened again, so that the liquified refrigerant is newly transferred from the refrigerant container 145 to the first heat exchanger 150. Thus, the control valve 143 alternates between the opened state and the closed state at regular intervals when the temperature sensed by the temperature sensing part 124 is lower than the reference temperature and the operation of the compressor 121 is suspended, to thereby perform the defrosting operation.

As described above, the control valve 143 of the defroster 140 according to the second embodiment alternates between the opened state and the closed state at regular intervals, to thereby solve the problem of the first embodiment in which the defrosting operation is not effectively performed because the surface temperature of the compressor 121 is too rapidly decreased to gasify the liquified refrigerant by the liquified refrigerant continuously transferred according as the control valve 143 is steadily in the opened state when the temperature sensed by the temperature sensing part 124 is lower than the reference temperature and the operation of the compressor 121 is suspended.

Figure 8:
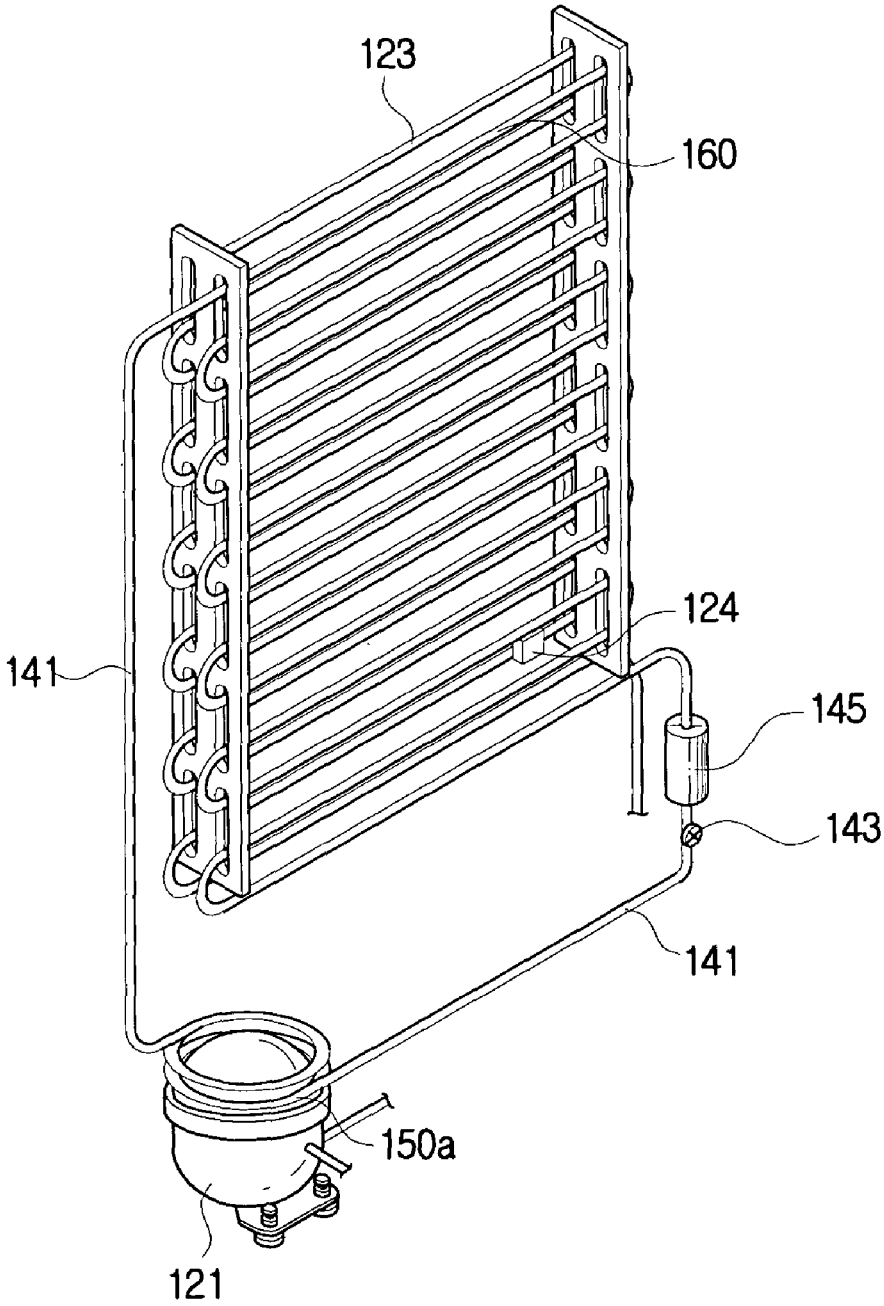
FIG. 8 is a partial perspective view of the refrigerator according to a second embodiment of the present invention.

FIG. 8 is a partial perspective view of the refrigerator according to a third embodiment of the present invention. The defroster 140 of the refrigerator according to the third embodiment is not provided with a heat storing tank in the first heat exchanger 150*a*, unlike the defroster 140 of the refrigerator according to the first and second embodiments. Instead, the heat pipe 141, wound spirally several times, replaces the heat storing tank. With this configuration, the refrigerator according to the third embodiment can also achieve the aspects as described in the Summary of the Invention above, with a more simplified structure than that of the first and second embodiments of the present invention.

The embodiments described above have been targeted for the defroster of the present invention used in defrosting the refrigerating device of the refrigerator. However, this defroster can also be installed in air conditioners comprising a refrigerating device, to perform its defrosting process.

The refrigerator according to the present invention is equipped with the heat pipe forming a closed loop so as to allow the refrigerant to be circulated therein, the first heat exchanger provided in the lower part of the heat pipe, absorbing the heat generated from the compressor, the second heat exchanger provided adjacent to the evaporator in the upper part of the heat pipe, discharging the heat into the evaporator, and a control valve provided between the first and the second heat exchangers, opening and closing the heat pipe. With this configuration, if the control valve is opened, the refrigerant cooled and liquified in the second heat exchanger 160 forces out the refrigerant heated and gasified in the first heat exchanger 150 by its own weight, and the gasified refrigerant flows up to the second heat exchanger 160, discharging heat into the evaporator 123 and then being condensed. Through these operations, the defrosting process is performed. The refrigerator according to the present invention does not require a pump to circulate the refrigerant, having a simplified structure, and the frost on the evaporator can be easily removed by circulating the refrigerant with the use of the waste heat of the compressor 121, without power consumption.

Further, the defroster of the refrigerator according to the present invention comprises the temperature sensing part sensing the surface temperature of the evaporator, so that the defrosting process is performed whenever the temperature sensed by the temperature sensor is lower than the reference temperature and the compressor is in suspension. Therefore, the frost deposited on the evaporator, even though it is of the small amount, can be removed, thereby enhancing the performance of the evaporator. Further, the frost is prevented from being partially deposited on the evaporator, thereby preventing the inner temperature of the refrigerator from being increased according as a part of the evaporator, on which the frost is not deposited, is heated while the defrosting operation is performed.

Further, in the defroster of the refrigerator according to the present invention, the control valve alternates between the opened state and the closed state at regular intervals, so that the surface temperature of the compressor is prevented from being rapidly lowered, thereby performing the defrosting operation effectively.

As described above, the present invention provides a defroster and refrigerator employing the same which has a simplified structure, capable of easily removing the frost on the evaporator by circulating the refrigerant with the use of the waste heat of the compressor, without power consumption.

Further, the present invention provides a defroster and refrigerator employing the same, in which the temperature sensing part sensing the surface temperature of the evaporator, so that the defrosting process is performed whenever the temperature sensed by the temperature sensor is lower than the reference temperature and the compressor is in suspension. Therefore, the frost deposited on the evaporator, even though it is of the small amount, can be removed, thereby enhancing the performance of the evaporator. Further, the frost is prevented from being partially deposited on the evaporator, thereby preventing the inner temperature of the refrigerator from being increased according as a part of the evaporator, on which the frost is not deposited, is heated while the defrosting operation is performed.

Further, the present invention provides a defroster and refrigerator employing the same, in which the control valve alternates between the opened state and the closed state at regular intervals, so that the surface temperature of the compressor is prevented from being rapidly lowered, thereby performing the defrosting operation effectively.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A refrigerator having a main body, and a compressor and an evaporator in the main body, comprising:

a heat pipe forming a closed loop so as to allow the refrigerant to be circulated therein;

a first heat exchanger provided in the heat pipe, absorbing heat generated from the compressor;

a second heat exchanger provided in an upper part between the heat pipe and the first heat exchanger adjacent to the evaporator, discharging heat into the evaporator; and a control valve positioned between the first and second heat exchangers, opening and closing the heat pipe, wherein the refrigerant cooled and liquified in the second heat exchanger forces out the refrigerant heated and gasified in the first heat exchanger by gravity, when the control valve is opened.

2. The refrigerator according to claim 1, further comprising a refrigerant container positioned between the control valve and the second heat exchanger, storing therein the refrigerant cooled and liquified in the second heat exchanger.

3. The refrigerator according to claim 2, wherein the first heat exchanger includes a heat storing tank in contact with the compressor, storing therein the heat generated from the compressor.

4. The refrigerator according to claim 1, further comprising a temperature sensing part sensing a surface temperature of the evaporator.

5. The refrigerator according to claim 4, wherein the control valve is opened when the compressor is suspended, and is closed when the compressor resumes operation or the temperature sensed by the temperature sensing part is higher than a predetermined reference temperature.

6. The refrigerator according to claim 5, wherein the control valve alternates between the opened state and the closed state at regular intervals when the compressor is in suspension and the temperature sensed by the temperature sensing part is lower than the reference temperature.

7. The refrigerator according to claim 4, wherein the second heat exchanger is bent several times in correspondence to the evaporator.

8. The refrigerator according to claim 2, further comprising a temperature sensing part sensing a surface temperature of the evaporator.

9. The refrigerator according to claim 8, wherein the control valve is opened when the compressor is suspended, and is closed when the compressor resumes operation or the temperature sensed by the temperature sensing part is higher than a predetermined reference temperature.

10. The refrigerator according to claim 9, wherein the control valve alternates between the opened state and the closed state at regular intervals when the compressor is in suspension and the temperature sensed by the temperature sensing part is lower than the reference temperature.

11. The refrigerator according to claim 8, wherein the second heat exchanger is bent several times in correspondence to the evaporator.

12. The refrigerator according to claim 3, further comprising a temperature sensing part sensing a surface temperature of the evaporator.

13. The refrigerator according to claim 12, wherein the control valve is opened when the compressor is suspended, and is closed when the compressor resumes operation or the temperature sensed by the temperature sensing part is higher than a predetermined reference temperature.

14. The refrigerator according to claim 13, wherein the control valve alternates between the opened state and the closed state at regular intervals when the compressor is in suspension and the temperature sensed by the temperature sensing part is lower than the reference temperature.

15. The refrigerator according to claim 12, wherein the second heat exchanger is bent several times in correspondence to the evaporator.

16. The refrigerator according to claim 2, wherein the first heat exchanger is formed by winding the heat pipe in contact with the compressor spirally several times, to store therein the heat generated from the compressor.

17. A defroster defrosting an evaporator provided in a refrigerating device, comprising:

a heat pipe forming a closed loop so as to allow the refrigerant to be circulated therein;

a first heat exchanger provided in the heat pipe, absorbing heat generated from a compressor provided in the refrigerating device;

a second heat exchanger provided in an upper part between the heat pipe and the first heat exchanger adjacent to the evaporator, discharging heat into the evaporator; and a control valve positioned between the first and second heat exchangers, opening and closing the heat pipe, wherein the refrigerant cooled and liquified in the second heat exchanger is circulated while forcing out the refrigerant heated and gasified in the first heat exchanger by gravity, when the control valve is opened.

18. The defroster according to claim 17, further comprising a refrigerant container positioned between the control valve and the second heat exchanger, storing therein the refrigerant cooled and liquified in the second heat exchanger.

19. The defroster according to claim 18, wherein the first heat exchanger includes a heat storing tank in contact with the compressor, storing therein the heat generated from the compressor.

20. The refrigerator according to claim 17, further comprising a temperature sensing part sensing a surface temperature of the evaporator.

21. The refrigerator according to claim 20, wherein the control valve is opened when the compressor is suspended, and is closed when the compressor resumes operation or the temperature sensed by the temperature sensing part is higher than a predetermined reference temperature.

22. The refrigerator according to claim 21, wherein the control valve alternates between the opened state and the closed state at regular intervals when the compressor is in suspension and the temperature sensed by the temperature sensing part is lower than the reference temperature.

23. The refrigerator according to claim 20, wherein the second heat exchanger is bent several times in correspondence to the evaporator.

24. The refrigerator according to claim 18, further comprising a temperature sensing part sensing a surface temperature of the evaporator.

25. The refrigerator according to claim 24, wherein the control valve is opened when the compressor is suspended, and is closed when the compressor resumes operation or the temperature sensed by the temperature sensing part is higher than a predetermined reference temperature.

26. The refrigerator according to claim 25, wherein the control valve alternates between the opened state and the closed state at regular intervals when the compressor is in suspension and the temperature sensed by the temperature sensing part is lower than the reference temperature.

27. The refrigerator according to claim 24, wherein the second heat exchanger is bent several times in correspondence to the evaporator.

28. The refrigerator according to claim 19, further comprising a temperature sensing part sensing a surface temperature of the evaporator.

29. The refrigerator according to claim 28, wherein the control valve is opened when the compressor is suspended, and is closed when the compressor resumes operation or the temperature sensed by the temperature sensing part is higher than a predetermined reference temperature.

30. The refrigerator according to claim 29, wherein the control valve alternates between the opened state and the closed state at regular intervals when the compressor is in suspension and the temperature sensed by the temperature sensing part is lower than the reference temperature.

31. The refrigerator according to claim 28, wherein the second heat exchanger is bent several times in correspondence to the evaporator.

32. The refrigerator according to claim 18, wherein the first heat exchanger is formed by winding the heat pipe in contact with the compressor spirally several times, to store therein the heat generated from the compressor.

* * * * *

UNITED STATES PATENT AND TRADEMARK OFFICE

CERTIFICATE OF CORRECTION

PATENT NO. : 7,000,414 B2
APPLICATION NO. : 10/632864
DATED : February 21, 2006
INVENTOR(S) : Byoung-in Lee et al.

It is certified that error appears in the above-identified patent and that said Letters Patent is hereby corrected as shown below:

On the title page, item, (54) change “DEFROST” to --DEFROSTER--

Column 1, line 1, change “DEFROST” to --DEFROSTER--

Signed and Sealed this

Twenty-second Day of August, 2006

JON W. DUDAS
*Director of the United States Patent and Trademark Office*